United States Patent [19]

Palty

[11] 4,404,492

[45] Sep. 13, 1983

[54] CATHODE STRUCTURE FOR CATHODE RAY TUBES AND METHOD FOR PRODUCING SAME

[75] Inventor: George Palty, Seneca Falls, N.Y.

[73] Assignee: North American Philips Consumer Electronics Corp., New York, N.Y.

[21] Appl. No.: 295,878

[22] Filed: Aug. 24, 1981

[51] Int. Cl.[3] ..... H01J 1/02

[52] U.S. Cl. ..... 313/355; 313/346 R; 313/352; 427/77

[58] Field of Search ..... 252/500, 510; 427/77, 427/78; 428/375; 313/355, 352, 346 R, 346 DC

[56] References Cited

U.S. PATENT DOCUMENTS

| | | | |
|---|---|---|---|
| 2,876,139 | 3/1959 | Flowers | 313/355 |
| 2,904,717 | 9/1959 | Kerstetter | 313/355 |
| 3,113,236 | 12/1963 | Lemmens et al. | 313/346 DC |
| 3,240,569 | 3/1966 | Buescher | 313/346 R |
| 4,279,784 | 7/1981 | Misumi et al. | 313/346 DC |

*Primary Examiner*—Harold A. Dixon

*Attorney, Agent, or Firm*—Thomas A. Briody; Jack Oisher; John C. Fox

[57] ABSTRACT

Cathode structures for cathode ray tubes are multi-layer structures wherein the bond between the emissive coating and the substrate is improved by forming the coating from a laminate of at least two self-supporting layers of differing compositions, the bottom layer optimized for bonding to the substrate and the top layer optimized for emissive properties.

14 Claims, 3 Drawing Figures

CATHODE STRUCTURE FOR CATHODE RAY TUBES AND METHOD FOR PRODUCING SAME

BACKGROUND OF THE INVENTION

1. Field of the Invention

This invention relates to cathode structures for cathode ray tubes, and to a method for producing them, and more particularly relates to cathode structures produced from laminates of self-supporting layers wherein the bottom layer composition is optimized for bonding to the substrate, while the top layer composition is optimized for electron emissive properties.

2. Prior Art

Cathode structures for cathode ray tubes desirably exhibit uniform electron emissions over an extended lfe cycle and under a variety of operating conditions. In addition, such cathode structures must be manufactured at the lowest possible cost. Because of such stringent requirements, particularly reliability and cost, there is great reluctance on the part of high volume manufacturers of cathode ray tubes to introduce new cathode structures or methods. Nevertheless, presently used cathode structures and methods exhibit limitations sufficiently troublesome to justify continuing investigations of alternate structures and methods.

These limitations include poor adherence of the emissive layer to its substrate, non-uniformity of emissions, and variations in the cathode-to-grid spacings ($K-G_1$ spacings) of the electron gun, resulting in out-of-specification values for cut-off voltages. Both non-uniformity of emissions and variations in the $K-G_1$ spacings can result from non-uniformity in the thickness of the emissive layer. Particularly in the case of the sprayed coatings widely in use today, such non-uniform thicknesses occur not only from one cathode coating to another, but also within a single cathode coating. In addition, sprayed coatings tend to lack not only the thickness uniformity, but also the degree of surface smoothness of coatings produced by other techniques, such as casting a film of the potentially emissive material in an organic matrix. See. U.S. Pat. Nos. 2,974,364; 2,986,671; and 3,223,569, assigned to the present Assignee. Such variations in thickness and surface smoothness can lead to variations in quality of the spot produced from the impingement of the electron beam on the phosphor screen.

Adherence problems arise, particularly during operation near the high end of the normal temperature range, and can appear as lifting, flaking, or blistering of the emissive coating. Such adherence problems may be due in part to the dissimilarity of the substrate material, usually a nickel alloy, from the potentially emissive material, usually a mixture of alkaline earth carbonates. One approach to this problem has been the incorporation of some nickel into the emissive coating. See, for example, U.S. Pat. No. 3,879,830, assigned to the present Assignee. Unfortunately, such incorporation leads to a decrease in the emissivity of the coating. Another approach has been to form a separate layer of nickel or nickel-containing material between the substrate and the emissive layer, such as by spraying, brushing, plating, cladding, etc. See U.S. Pat. Nos. 3,327,158; 4,129,801; 4,114,243; 4,069,436; 4,053,807; 3,393,090; 3,374,385; 2,996,795 and 2,913,812. Such an approach obviously adds to the complexity of any manufacturing operation, particularly when the nickel undercoat requires further processing (e.g., sintering) prior to application of the emissive layer.

Accordingly, objectives of the present invention include: providing a cathode structure for cathode ray tubes which exhibits good adherence between the emissive layer and its supporting substrate; providing an emissive layer with optimum emissivity; providing an emissive layer which exhibits both uniformity of thickness and surface smoothness; and providing a method for producing such structures simply and reliably.

SUMMARY OF THE INVENTION

Figure 1:
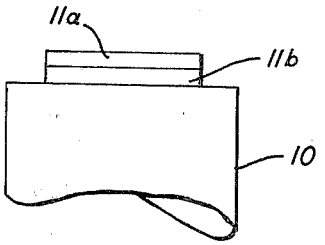
FIG. 1 is a front elevation view of one embodiment of a cathode structure of the invention, having a two-layer structure adherent to the substrate.

Cathode structures for cathode ray tubes are multilayer structures wherein the bond between the emissive coating and the substrate is improved by forming the coating from a laminate of at least two self-supporting layers of differing compositions, the bottom layer optimized for bonding to the substrate and the top layer optimized for emissive properties.

In accordance with broad aspects of the invention, there is provided a cathode structure for cathode ray tubes comprising: a supporting substrate of a nickel alloy; and a multilayer structure adherent to the substrate, at least the innermost layer in contact with the substrate comprising nickel-containing material, characterized in that the multilayer structure is formed from a laminate of at least two self-supporting layers, each layer comprised of particles of inorganic material dispersed in a fugitive organic binder matrix.

The inorganic particles from which the electron emissive material is formed consists essentially of a mixture, usually co-precipitated, of particles of alkaline earth carbonate selected from the group consisting of Ba, Sr and Ca carbonates.

Preferably, barium carbonate is present in the amount of about 55 to 60 weight percent, strontium carbonate is present in the amount of about 36 to 45 weight percent, and calcium carbonate is present in the amount of about 0 to 4 weight percent.

In accordance with a preferred embodiment of the invention, the multilayer structure consists essentially of a first layer in contact with the substrate, and a second layer in contact with the first layer, the composition of the first layer consisting essentially of from about 5 to 100 weight percent of the nickel-containing material, and from about 0 to 95 weight percent of electron emissive material, and the composition of the second layer consisting essentially of from about 95 to 100 weight percent of electron emissive material and from about 0 to 5 weight percent of a nickel-containing material.

In accordance with another preferred embodiment, a third layer is provided between the first and second layers, the composition of the third layer consisting essentially of from about 50 to 98 weight percent of electron emissive material and from about 2 to 50 weight percent of a nickel-containing material.

In accordance with another aspect of the invention, there is provided a method for producing a cathode structure for cathode ray tubes, the method comprising: depositing a drop of solvent mixture onto a supporting substrate of a nickel alloy; forming a laminated button of at least two self-supporting layers, each layer comprised of particles if inorganic material dispersed in a fugitive organic binder matrix, the inorganic particles of at least the outermost layer comprising potentially electron emissive material and the inorganic particles of at least the innermost layer comprising nickel-containing material; floating the button on the drop in a manner so that the innermost layer faces the substrate; and selectively evaporating the solvent mixture to center and adhere the button to the substrate.

In accordance with a preferred embodiment of the method, following evaporation of the solvent mixture, the structure is: first heated to a temperature sufficient to substantially remove the fugitive organic binder, and to substantially convert the alkaline earth carbonates to alkaline earth oxides; and then heated in a vacuum at a higher temperature, such higher temperature sufficient to activate the cathode structure by reducing at least a portion of the alkaline earth oxides to base metal, and to sinter at least a portion of the particles to each other and to the substrate.

DESCRIPTION OF THE PREFERRED EMBODIMENTS

Referring now to FIG. 1, there is shown one embodiment of a cathode structure of the invention, wherein substrate 10 supports a two layer electron emissive structure 11, composed of a first layer 11*a* in contact with the substrate and a second layer 11*b* of different composition in contact with the first layer. Substrate 11 is composed of an alloy of nickel typically containing about 2 to 4 weight percent tungsten, up to about 0.1 weight percent zirconium, remainder substantially nickel. Typical commercial alloys used for this purpose are known by the trade-names "Nitung 4", having a composition of about 96 weight percent nickel, 4 weight percent tungsten, and "Nizir-W", having a composition of about 98 weight percent nickel, about 2 weight percent tungsten, and about 0.05 weight percent zirconium.

The electron emissive material in structure 11 is composed of products of the thermal decomposition or breakdown and activation of barium carbonate and strontium carbonate, and optionally calcium carbonate. As is known, such breakdown and activation converts these alkaline earth carbonates first to their respective oxides (by thermal decomposition) and then to base metal (under the influence of a reducing agent such as W in the substrate). Because of its relatively low work function, barium is the primary source of electrons.

Another component of the structure 11 is a nickel-containing material, defined herein as nickel, a compound of nickel, an alloy of nickel, or a mixture of one or more of these. In compound form, nickel would typically be present as an oxide. Alloys could correspond in composition to that of the substrate or could contain other alloying elements in amounts up to 50 weight percent. This nickel-containing material is mainly present in layer 11*a*, with little or none in layer 11*b*, while the electron emissive material may be present in layer 11*a* and is, of course, essential to layer 11*b*. A preferred embodiment is one in which layer 11*a* contains from about 20 to 30 weight percent of the nickel-containing material, and about 70 to 80 weight percent of electron emissive material, while layer 11*b* is essentially 100 percent emissive material.

Figure 2:
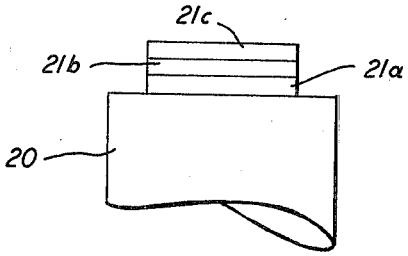
FIG. 2 is a front elevation view of another embodiment of a cathode structure of the invention, having a three-layer structure adherent to the substrate.

Referring to FIG. 2, there is shown another embodiment of the cathode structure of the invention, wherein substrate 20 supports a three layer electron emissive structure 21, containing a nickel-containing material and electron emissive material. Layer 21*a* contains a substantial amount of nickel-containing material, from 5 to 100 weight percent, while layer 21*b* contains less nickel-containing material, from 2 to 50 weight percent, and layer 21*c* contains little or no nickel-containing material, 0 to 5 weight percent. Such a three layer structure provides a more gradual transition or compositional gradient from substrate to emissive surface than the two layer structure of FIG. 1.

Figure 3:
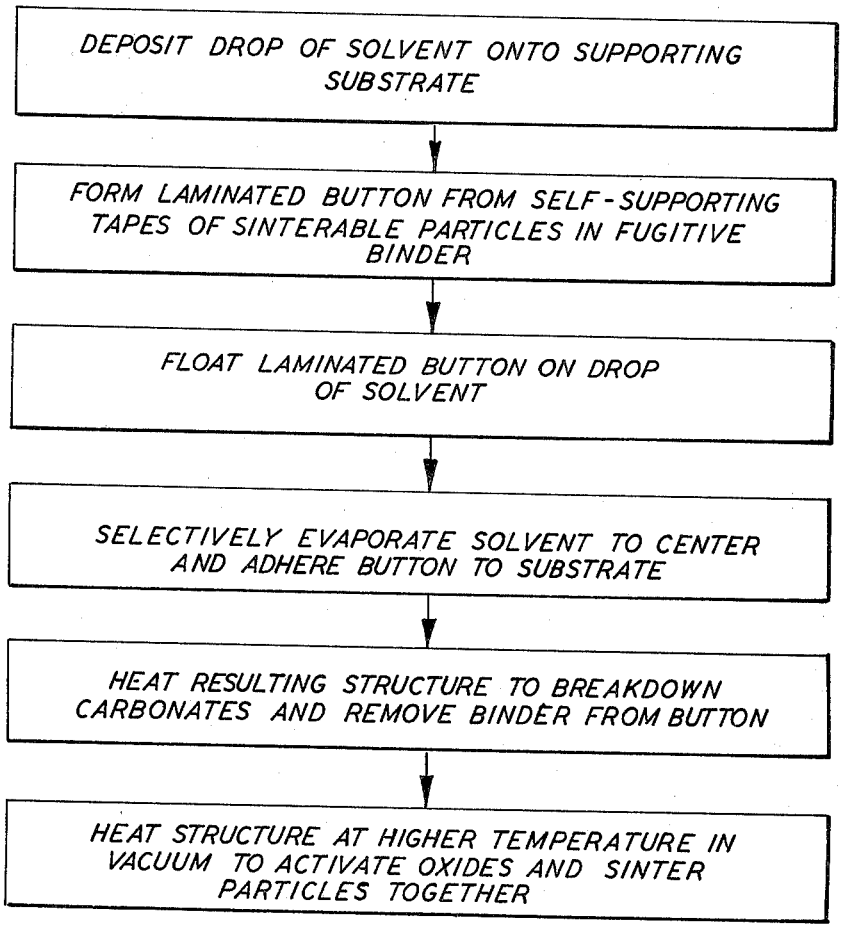
FIG. 3 is a block flow diagram illustrating one embodiment of a method for producing the cathode structure of the invention.

Referring now to FIG. 3, there is shown a block flow diagram, representing the essential steps of a method for producing the cathode structure of the invention. The first steps are the formation of a laminated button of self-supporting layers of inorganic particles in a fugitive organic binder matrix, and the deposition of a drop of solvent mixture onto the supporting substrate. The laminated buttons are preferably formd by bringing into contact at least a portion of two endless tapes (tapes of indeterminate length) of the self-supporting layers and punching out the buttons in the region of contact. Each button then falls a short distance to float on the solvent mixture drop resting on the substrate.

Methods, compositions and apparatus suitable for producing such self-supporting tapes are known and are described, for example, in U.S. Pat. Nos. 4,197,152; 4,197,153; 3,323,879; 3,171,817; 2,986,671; 2,974,364; and 2,965,927; all assigned to the present Assignee. The preferred composition for this application is an ethyl cellulose-based composition, although acrylic-based and nitrocellulose-based compositions should work equally as well. One ethyl cellulose-based composition listed in U.S. Pat. No. 2,986,671, would additionally contain toluene, alcohol, ethylene carbonate, ethyl acetate, barium nitrate and diethylene glycol monobutyl ether, known by the trade-name of butyl "Carbitol". The buttons typically have a diameter of about 0.070-inch and a thickness of about 0.001 to 0.006-inch.

The solvent is any solvent which will wholly or partially dissolve the organic binder matrix. However, it is preferred to use a mixture of polar and non-polar liquids, wherein the non-polar liquid is the solvent for the organic binder, as more fully described in U.S. Pat. Nos. 4,197,152 and 4,197,153 assigned to the present Assignee.

A suitable solvent mixture for an ethyl cellulose-based self-supporting layer would include water and ethylene glycol monobutyl ether known by the trade-name as butyl "Cellosolve". The water would be in the range of about 50 to 90 percent by weight while the butyl "Cellosolve" would be in the range of about 10 to 50 percent by weight. Moreover, one preferred embodiment includes a solvent mixture of about 65 percent by weight water and about 35 percent by weight of butyl "Cellosolve".

At least one rounded drop of a suitable solvent or solvent mixture, such as described above, is deposited onto the substrate. At least one rounded drop or an amount at least sufficient to initially "float" an applied button is a minimum requirement. However, amounts greater than a rounded drop have not proven to be deleterious or harmful. Thus, a drop in an amount sufficient to completely wet the substrate and sufficient to "float" an applied button of self-supporting layers is provided.

Following, the substrate with the button initially "floating" on the rounded drop is heated in an amount sufficient to evaporate the solvent or preferentially evaporate the liquids of the solvent mixture. For the water-butyl "Cellosolve" mixture described above, heating is carried out in the temperature range of about 60° C. to 120° C. Thereafter, additional heat is added in an amount to evaporate the higher boiling liquid, wherein the binder of the layers is soluble, and causes the binder in the layers to affix the button to the substrate. For the water-butyl "Cellosolve" mixture, heating is carried out in the temperature range of about 160° C. to 200° C.

The laminated button now adhered to the substrate contains "potentially emissive" material, so referred to because only subsequent processing renders the material electron emissive. Such processing normally takes place during and immediately after evacuation of the cathode ray tube and sealing of the electron gun in the evacuated tube. Such processing is referred to as "breakdown" and "activation", wherein during tube evacuation the alkaline earth carbonates are broken down or thermally decomposed to the respective oxides, and subsequently the oxides are activated to base metal, in which form barium in particular is electron emissive. During heating to achieve breakdown, which normally occurs at a temperature of about 900° C., the organic binder is also removed from the cathode structure. During activation, which normally occurs at a temperature of about 1050° C., some sintering together of the remaining inorganic particles in the structure occurs, as well as some sintering of the particles to the substrate. Thus, a highly adherent cathode structure is formed. In addition to their adherence to the substrate, such structures are also characterized by a high degree of thickness uniformity and surface smoothness. For example, the thickness of the self-supporting tapes used to form the laminated buttons will normally vary no more than about 0.0001-inch. Surface is very much smoother than can be achieved with any of the sprayed coatings now in use. Such thickness uniformity and surface smoothness are preserved in the activated cathode structure, enabling close control of cathode-to-grid spacing, (and thus cut-off voltage), as well as uniform electron emissions, resulting in uniform spot quality at the screen. For example, using the cathode structures of the invention, K-$G_1$ spacings are obtainable which vary only 0.0001-inch, versus 0.0005-inch for sprayed cathode coatings.

INDUSTRIAL APPLICABILITY

Cathode structures described herein are particularly suitable for use in cathode ray tubes for color and black-and-white entertainment and data display applications.

I claim:

1. A cathode structure for cathode ray tubes comprising:
   (a) a supporting substrate of a nickel alloy; and
   (b) a multilayer structure adherent to the substrate, at least the innermost layer in contact with the substrate comprising Ni-containing material, and at least the outermost layer comprising electron emissive material, characterized in that the multilayer structure is formed from a laminate of at least two self-supporting layers, each layer comprised of particles of inorganic material dispersed in a fugitive organic binder matrix.

2. The structure of claim 1 wherein the inorganic particles from which the electron emissive material is formed consists essentially of a mixture of particles of alkaline earth carbonate selected from the group consisting of Ba, Sr and Ca carbonates.

3. The structure of claim 2 wherein Ba carbonate is present in the amount of about 55 to 60 weight percent, Sr carbonate is present in the amount of about 36 to 45 weight percent, and Ca carbonate is present in the amount of about 0 to 4 weight percent.

4. The structure of claim 1 wherein the multilayer structure consists essentially of a first layer in contact with the substrate, and a second layer in contact with the first layer, the composition of the first layer consisting essentially of from about 5 to 100 weight percent of the Ni-containig material, and from about 0 to 95 weight percent of electron emissive material, and the composition of the second layer consisting essentially of from about 95 to 100 weight percent of electron emissive material and from about 0 to 5 weight percent of a nickel-containing material.

5. The structure of claim 4 wherein a third layer is provided between the first and second layers, the composition of the third layer consisting essentially of from about 50 to 98 weight percent of electron emissive material and from about 2 to 50 weight percent of a nickel-containing material.

6. The structure of claim 4 wherein the composition of the first layer consists essentially of from about 20 to 30 weight percent of the Ni-containing material, and about 70 to 80 weight percent of the electron emissive material, and the composition of the second layer consists essentially of about 100 percent of electron emissive material.

7. The structure of claim 1 wherein the nickel alloy substrate contains from about 2 to 4 weight percent tungsten, from about 0 to about 0.1 weight percent zirconium, remainder substantially nickel.

8. The structure of claim 1 wherein the thickness of each self-supporting layer is in the range of from about 0.001" to 0.006".

9. A method for producing a cathode structure for cathode ray tubes, the method comprising:
   (a) depositing a drop of solvent mixture onto a supporting substrate of a Ni alloy;
   (b) forming a laminated button of at least two self-supporting layers, each layer comprised of particles of inorganic material dispersed in a fugitive organic binder matrix, the inorganic particles of at least the outermost layer comprising potentially electron emissive material and the inorganic particles of at least the innermost layer comprising nickel-containing material;
   (c) floating the button on the drop in a manner so that the innermost layer faces the substrate; and
   (d) selectively evaporating the solvent mixture to center and adhere the button to the substrate.

10. The method of claim 9 wherein the potentially emissive material consists essentially of a mixture of particles of alkaline earth carbonates selected from the group consisting of Ba, Sr and Ca carbonates.

11. The method of claim 10 wherein Ba carbonate is present in the amount of about 55 to 60 weight percent, Sr carbonate is present in the amount of about 36 to 45 weight percent, and Ca carbonate is present in the amount of about 0 to 4 weight percent.

12. The method of claim 9 wherein following evaporation of the solvent mixture, the structure is: first heated to a temperature sufficient to substantially remove the fugitive organic binder, and to substantially convert the alkaline earth carbonates to alkaline earth oxides; and then heated in a vacuum at a higher temperature, such higher temperature sufficient to activate the cathode structure by reducing at least a portion of the alkaline earth oxides to base metal, and to sinter at least a portion of the particles to each other and to the substrate.

13. The method of claim 12 wherein such heating steps are carried out during incorporation of the cathode structure into a cathode ray tube.

14. The method of claim 9 wherein the laminated buttons are formed by brining into contact portions of at least two endless tapes of self-supporting material, and punching buttons from the tapes in the area of contact.

* * * * *